US011156344B2

(12) United States Patent
Lee et al.

(10) Patent No.: US 11,156,344 B2
(45) Date of Patent: Oct. 26, 2021

(54) LUMINAIRE, MOUNTING KIT AND MOUNTING METHOD

(71) Applicant: SIGNIFY HOLDING B.V., Eindhoven (NL)

(72) Inventors: Yu Lee, Eindhoven (NL); Jisong Xu, Eindhoven (NL); Liang Bao, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 16/973,193

(22) PCT Filed: Jun. 11, 2019

(86) PCT No.: PCT/EP2019/065127
§ 371 (c)(1),
(2) Date: Dec. 8, 2020

(87) PCT Pub. No.: WO2019/238632
PCT Pub. Date: Dec. 19, 2019

(65) Prior Publication Data

US 2021/0262643 A1 Aug. 26, 2021

(30) Foreign Application Priority Data

Jun. 14, 2018 (WO) ..... PCT/CN2018/091265
Jul. 17, 2018 (EP) ..... 18184010

(51) Int. Cl.
*F21V 17/16* (2006.01)
*F21S 8/02* (2006.01)
(Continued)

(52) U.S. Cl.
CPC ..... *F21V 17/162* (2013.01); *F21S 8/026* (2013.01); *F21V 7/06* (2013.01); *F21V 21/04* (2013.01); *F21Y 2115/10* (2016.08)

(58) Field of Classification Search
None
See application file for complete search history.

(56) References Cited

U.S. PATENT DOCUMENTS

2020/0018452 A1* 1/2020 Weyhaeghe ..... F21V 21/04

FOREIGN PATENT DOCUMENTS

CN 202532394 U 11/2012
CN 203309664 11/2013
(Continued)

*Primary Examiner* — Britt D Hanley
(74) *Attorney, Agent, or Firm* — Daniel J. Piotrowski

(57) ABSTRACT

A luminaire (20) for mounting in an annular housing (10) having a cylindrical sidewall with an inner diameter (15), said sidewall terminating in an upper rim (12) is disclosed. The luminaire (20) comprises a reflector (50) having a light exit aperture (51) mounted in an annular body and a wedge-shaped clip (40) movably attached to the annular body by a spring (44) such that the annular body has a first diameter not exceeding the inner diameter (15) when the clip is pressed against the body by compressing said spring; and a second diameter exceeding the inner diameter when said spring is relaxed. The clip (40) further comprises an outwardly inclined member (42) in the direction of the light exit aperture and the reflector further comprises an outwardly inclining groove (52) in the direction of the light exit aperture engaging with the outwardly inclined member (42) to facilitate easy release of the luminaire from its annular housing. A mounting kit including the luminaire and annular housing is also disclosed, as is a mounting method for mounting the luminaire in such an annular housing.

15 Claims, 8 Drawing Sheets

(51) Int. Cl.

| | |
|---|---|
| ***F21V 21/04*** | (2006.01) |
| ***F21V 7/06*** | (2006.01) |
| ***F21Y 115/10*** | (2016.01) |

(56) References Cited

FOREIGN PATENT DOCUMENTS

| | | | |
|---|---|---|---|
| DE | 3249401 | A1 | 10/1984 |
| DE | 102004058241 | A1 | 6/2006 |
| DE | 102005032265 | A1 | 1/2007 |
| EP | 3141798 | A1 | 3/2017 |
| JP | 4305845 | B2 | 7/2009 |
| KR | 200909157 | U | 9/2009 |

* cited by examiner

10

40

40

40

50

LUMINAIRE, MOUNTING KIT AND MOUNTING METHOD

CROSS-REFERENCE TO PRIOR APPLICATIONS

This application is the U.S. National Phase application under 35 U.S.C. § 371 of International Application No. PCT/EP2019/065127, filed on Jun. 11, 2019, which claims the benefits of European Patent Application No. 18184010.9, filed on Jul. 17, 2018, and Chinese Patent Application No. PCT/CN2018/091265, filed on Jun. 14, 2018. These applications are hereby incorporated by reference herein.

FIELD OF THE INVENTION

The present invention relates to a luminaire for mounting in an annular housing having a cylindrical sidewall with an inner diameter, said sidewall terminating in an upper rim.

The present invention further relates to a mounting kit including such a luminaire and annular housing.

The present invention further relates to a method of mounting such a luminaire into such an annular housing.

BACKGROUND OF THE INVENTION

Several lighting applications exist in which an end user is expected to install a lighting product. Examples of such lighting products include downlights and accent lights. Such lighting products typically come as modular designs in which a luminaire is mounted in a housing. For such modular designs, it is important that the end user is provided with a satisfactory installation experience in which the lighting product can be installed in a straightforward manner. In addition, it is desirable that the luminaire can be easily released from its housing in which it is mounted, for example to facilitate maintenance of the luminaire or a surface such as a ceiling in which the housing is mounted.

An example of such a modular lighting product is disclosed in CN203309664U. This utility model relates to a vertical sliding device of a downlight comprising the downlight and a fixing frame. The downlight is provided with at least one sliding location assembly. The sliding location assembly comprises a sliding block, a baffle plate, a steel ball, a sliding cover plate, a steel ball spring and a sliding block spring. The sliding cover plate is fixedly connected to the downlight. The sliding block and the sliding cover plate are movably connected in a sleeved mode, and the sliding block can slide back and forth relative to the sliding cover plate. A steel ball hole is formed in the front-end surface of the sliding block, and a guide groove is formed in the back end of the sliding block. The baffle plate is fixed in the middle of the guide groove in the back end of the sliding block. The steel ball and the steel ball spring are arranged on the front section of the guide groove of the sliding block, and the two ends of the steel ball spring abut against the steel ball and the baffle plate respectively. The sliding block spring is arranged on the back section of the guide groove of the sliding block, and the two ends of the sliding block spring abut against the baffle plate and a rear end panel of the sliding cover plate respectively. Thus, the vertical sliding device of the downlight has the advantage of combining sliding and locating.

Although this provides an adjustable downlight, its mounting and dismounting is rather complex and cumbersome to the end user.

SUMMARY OF THE INVENTION

The present invention seeks to provide a luminaire that can be adjusted whilst mounted in its housing and at the same time can be mounted and is mounted from its housing in a cost-effective and straightforward manner.

The present invention further seeks to provide a mounting kit comprising such a luminaire and housing.

The present invention further seeks to provide a mounting method of such a luminaire in its housing.

According to an aspect, there is provided a luminaire for mounting in an annular housing having a cylindrical sidewall with an inner diameter, said sidewall terminating in an upper rim, the luminaire comprising a reflector having a light exit aperture mounted in an annular body and a wedge-shaped clip movably attached to the annular body by a spring such that the annular body has a first diameter not exceeding the inner diameter when the clip is pressed against the body by compressing said spring and a second diameter exceeding the inner diameter when said spring is relaxed; wherein the clip further comprises an outwardly inclined member in the direction of the light exit aperture and the reflector further comprises an outwardly inclining groove in the direction of the light exit aperture engaging with the outwardly inclined member.

Such a luminaire benefits from being adjustable through rotation as the wedge-shaped clip can rotate over the upper rim of the annular housing, whereas mounting and dismounting of the luminaire into and from the annular housing is straightforward. In particular, the engagement of the outwardly inclined member of the wedge-shaped clip with the outwardly inclining groove in the reflector ensures that the luminaire can be released from its annular housing in a straightforward manner, as a gentle pulling force exerted onto the reflector when the luminaire is mounted in its annular housing is translated into an inwardly directed force compressing the spring due to the interaction between the outwardly inclined member of the wedge-shaped clip with the outwardly inclining groove of the reflector such that the clip is pushed from the upper rim, thereby facilitating the easy release of the luminaire from its annular housing.

The luminaire preferably comprises at least a pair of said wedge-shaped clips in order to further stabilize the mounting of the luminaire within its annular housing.

In an embodiment, the annular body comprises a rotatable ring from which each spring extends such that the luminaire can be rotated when mounted in its annular housing. This for example may be desirable to aim the luminous output of the luminaire in a particular direction, for example when the luminaire comprises an angled tubular portion or the like guiding the luminous output.

The rotatable ring may further comprise an outer ring from which each spring extends, said outer ring resting on the upper rim when the luminaire is mounted in the annular housing and a pivoting inner ring mounted on the outer ring from which the reflector extends. This adds a further degree of adjustability to the luminaire as the pivoting inner ring may be used to change the angle under which the luminaire produces its luminous output.

In an embodiment, each wedge-shaped clip comprises a barb-shaped body having an upper edge and a lower edge thicker than the upper edge and an inclined outer surface extending between the upper edge and lower edge, said lower edge comprising a first surface and a second surface, wherein said first surface is arranged to laterally engage with the housing and the second surface is arranged to rest on the upper rim in order to provide a particularly stable interaction between the luminaire and its annular housing.

The luminaire may further comprise at least one solid state light element mounted within a chamber delimited by the reflector. Alternatively, the light source to be mounted within this chamber may be provided separately, i.e. may not come integral to the luminaire.

In a preferred embodiment, the luminaire is a downlight although it should be understood that embodiments of the present invention are not limited to downlights only but may be applied to any lighting product in which a luminaire is mounted in an annular housing.

According to another aspect, there is provided a mounting kit comprising an annular housing having a cylindrical sidewall with an inner diameter, said sidewall terminating in an upper rim and a luminaire for mounting in said annular housing, the luminaire comprising a reflector having a light exit aperture mounted in an annular body and a wedge-shaped clip movably attached to the annular body by a spring such that the annular body has a first diameter not exceeding the inner diameter when the clip is pressed against the body by compressing said spring; and a second diameter exceeding the inner diameter when said spring is relaxed, wherein the clip further comprises an outwardly inclined member in the direction of the light exit aperture and the reflector further comprises an outwardly inclining groove in the direction of the light exit aperture engaging with the outwardly inclined member. Such a mounting kit facilitates easy mounting and dismounting of the luminaire from its annular housing as explained in more detail above.

The annular housing may be made of any suitable material such as for example a polymer material, a metal or a metal alloy. Other materials, e.g. composite materials, may also be contemplated.

According to yet another aspect, there is provided a method of mounting a luminaire in an annular housing having a cylindrical sidewall with an inner diameter, said sidewall terminating in an upper rim, the luminaire comprising a reflector having a light exit aperture mounted in an annular body and a wedge-shaped clip movably attached to the annular body by a spring such that the annular body has a first diameter not exceeding the inner diameter when the clip is pressed against the body by compressing said spring; and a second diameter exceeding the inner diameter when said spring is relaxed, wherein the clip further comprises an outwardly inclined member in the direction of the light exit aperture and the reflector further comprises an outwardly inclining groove in the direction of the light exit aperture engaging with the outwardly inclined member, the method comprising inserting the luminaire into the annular housing, thereby causing the spring to be compressed against the annular body when the clip engages with the cylindrical sidewall; and the clip to be pushed onto the upper rim by the relaxation of said spring upon the clip having passed said cylindrical sidewall. This facilitates a straightforward mounting of the luminaire in the annular housing.

Furthermore, in order to easily release the luminaire from its annular housing, the method may further comprise exerting a pulling force on the reflector such that a resulting force exerted by the outwardly inclining groove onto the outwardly inclined member causes said spring to be compressed against the annular body.

BRIEF DESCRIPTION OF THE DRAWINGS

Embodiments of the invention are described in more detail and by way of non-limiting examples with reference to the accompanying drawings, wherein.

DETAILED DESCRIPTION OF THE EMBODIMENTS

Figure 1:
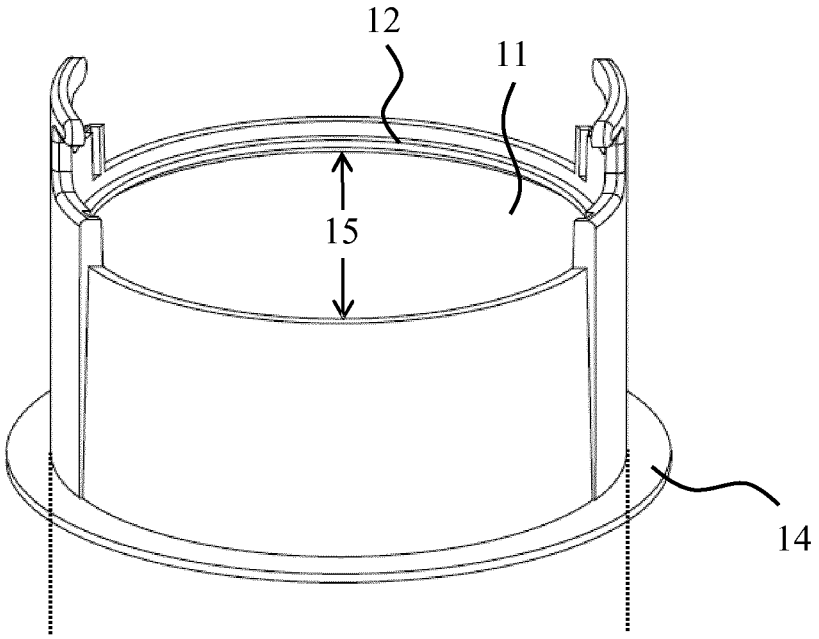
FIG. 1 schematically depicts a perspective view of an annular housing for mounting a luminaire according to an embodiment.

It should be understood that the Figures are merely schematic and are not drawn to scale. It should also be understood that the same reference numerals are used throughout the Figures to indicate the same or similar parts.

FIG. 1 schematically depicts an annular housing 10 for a luminaire, which may be mounted into a suspended surface such as a wall or ceiling by forming an aperture into the suspended surface through which the annular housing 10 can be pushed such that the lip 14 of the annular housing 10 covers any remaining gap between the annular housing 10 and the aperture in order to provide an aesthetically acceptable finish of the mounting of the annular housing 10 within the suspended surface. The annular housing 10 may be secured in such a suspended surface in any suitable manner, e.g. using spring-loaded brackets (not shown) or the like that can fold outwardly onto the suspended surface in order to retain the annular housing 10 against this surface. Many other suitable securing measures are known to the skilled person and it should be understood that any suitable securing mechanism for securing the annular housing 10 within such a suspended surface may be used in conjunction with the teachings of the present invention.

The annular housing 10 comprises a cylindrical sidewall 11 terminating in an upper rim or edge 12, which in a preferred embodiment extends fully around the cylindrical sidewall 11 to facilitate 360° rotation of a luminaire mounted on the upper rim 12 as will be explained in further detail below. Alternatively, the upper rim 12 may comprise one or more opposing sections facilitating the rotation of the luminaire across the length of each section, e.g. 90° rotation, 120° rotation, and so on. The cylindrical sidewall 11 and upper rim 12 have an internal diameter 15, which relevance will be discussed in further detail below. The annular housing 10 may be made of any suitable material, such as a polymer material, a metal, a metal alloy, a composite material or combinations thereof. Other suitable materials equally may be contemplated. At this point, it is noted that where reference is made to the upper rim 12, this does not necessarily mean that the annular housing 10 has to be oriented such that this rim defines an upper part of the annular housing 10. Instead, it should be understood that the upper rim 12 is defined as the rim or edge opposing the opening of the annular housing 10 through which the luminaire is inserted into the annular housing, i.e. the rim or edge with which the luminaire engages upon its mounting into the annular housing 10 as will be explained in further detail below.

Figure 2:
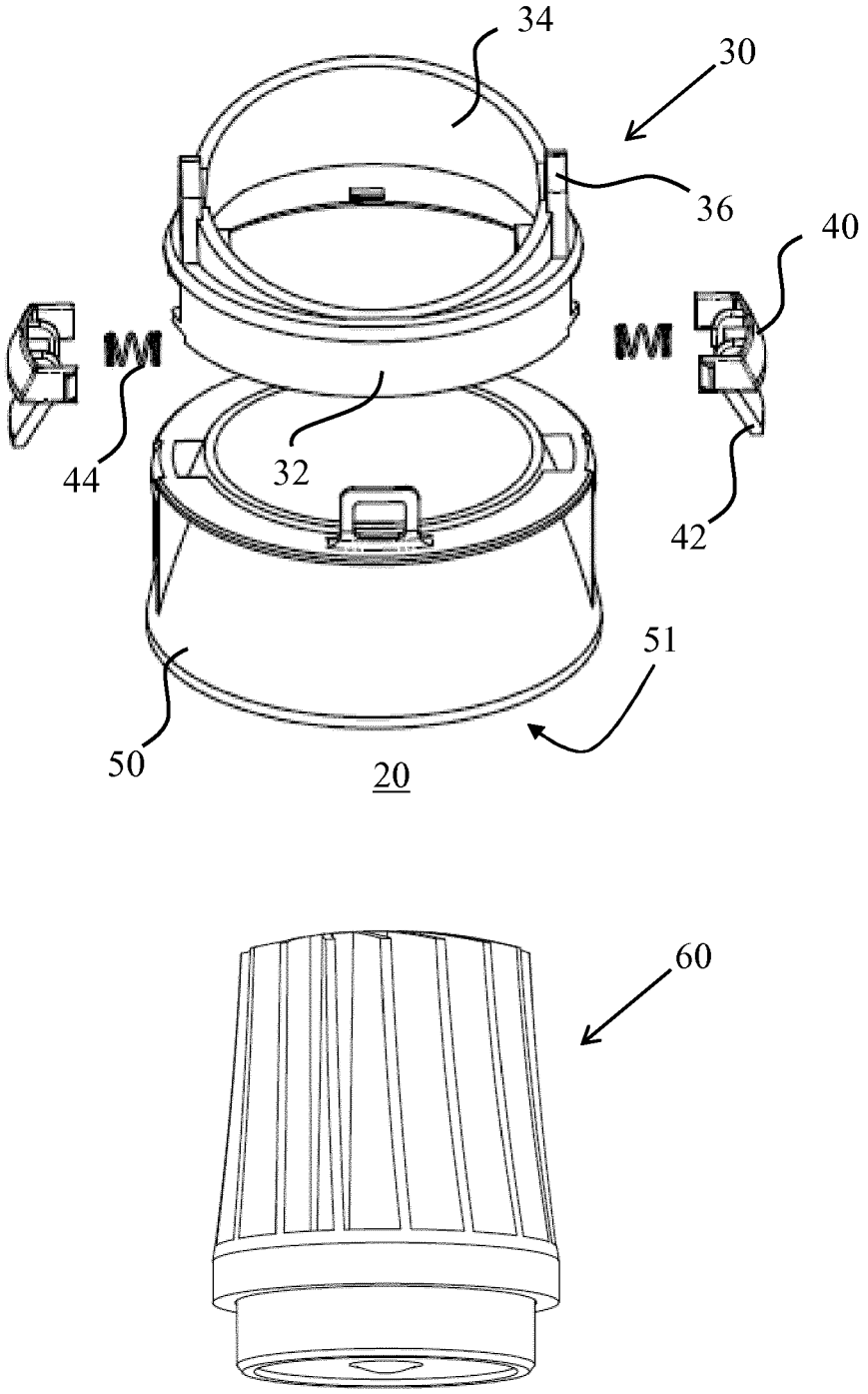
FIG. 2 schematically depicts an exploded view of a luminaire according to an embodiment.

An example embodiment of the luminaire 20 is schematically depicted in FIG. 2. The luminaire 20 comprises a body 30 against which a clip 40 and preferably at least a pair of clips 40 are mounted in a spring-loaded fashion using a spring 44 that allow such a clip 40 to be pressed inwardly, i.e. towards the body 30 such that the effective diameter of the body 30 as defined by the one or more clips 40 is adjustable. More specifically, the body 30 has a first effective diameter not exceeding the inner diameter 15 of the cylindrical sidewall 11 when the one or more clips 40 are pressed against the body 30, thereby compressing or energizing the spring 44, whereas the body 30 has a second effective diameter exceeding the first effective diameter and the inner diameter 15 of the cylindrical sidewall 11 when the spring 44 relaxes and pushes the clip 40 away from the body 30.

In a preferred embodiment, the body 30 comprises an outer ring 32 from which the one or more clips 40 extend such that when the luminaire 20 is mounted in the annular housing 10, the one or more clips 40 rest on the upper rim 12 and allow the rotation of the outer ring 32 relative to the annular housing 10 by the one or more clips 40 sliding over the upper rim 12. In this manner, the luminaire 20 may be rotated in the mounting plane within the annular housing 10. The body 30 further comprises a pivoting inner ring 34 that is mounted onto the outer ring 32 by means of a pair of mounting posts 36. The mounting posts 36 may be integral to the outer ring 32 or may be attached to the outer ring 32 in any suitable manner, e.g. using screws, clips, adhesive etc. The pivoting inner ring 34 is mounted onto the mounting posts 36 such that the pivoting inner ring 34 can swivel or pivot relative to the mounting plane of the luminaire 20 within the annular housing (i.e. relative to the outer ring 32) to facilitate out of plane adjustment of the luminaire 20 when mounted in the annular housing 10 in order to provide the luminaire 20 with a several degrees of adjustability when mounted.

A reflector 50 having a light exit aperture 51 may be mounted into the pivoting inner ring 34 in which a light source 60 such as one or more solid-state lighting elements, e.g. LEDs, may be mounted. Such a light source may be integral to the reflector 50 or alternatively the reflector 50 may be designed to receive such a light source, e.g. in the form of a light bulb or the like. The reflector 50 may have any suitable shape and may be made of any suitable material. For example, the reflector 50 may be a parabolic reflector such that at least the reflective surface delimiting a chamber of the reflector 50 in which the light source is present has a parabolic cross-section. Of course, other suitable shapes for the reflector 50 will be immediately apparent to the skilled person and it should be understood that embodiments of the present invention are not limited to a particular shape of reflector 50.

It is furthermore noted that in alternative embodiments, the pivoting inner ring 34 may be omitted from the design of the luminaire 20 such that the reflector 50 alternatively may be mounted in the outer ring 32. In such embodiments, the reflector 50 only may be rotated in the mounting plane of the luminaire 20 within the annular housing 10 by rotation of the outer ring 32 along the upper rim 12 of the annular housing 10 as previously explained.

Figure 3:
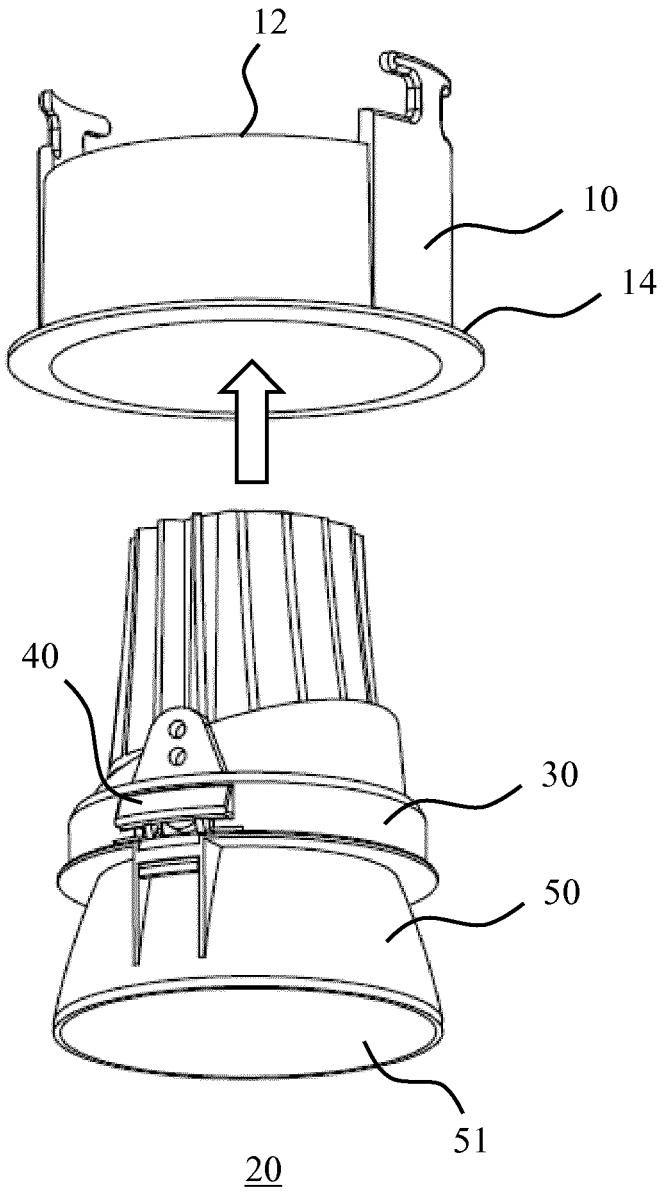
FIG. 3 schematically depicts a mounting method of a luminaire according to an embodiment in its annular housing.
Figure 4:
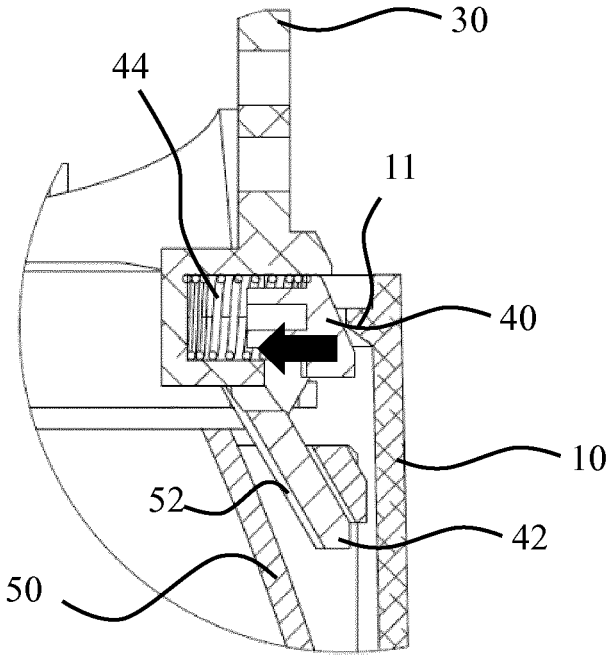
FIG. 4 schematically depicts the interaction between a detail of the luminaire and its annular housing during a first stage of the mounting method.
Figure 5:
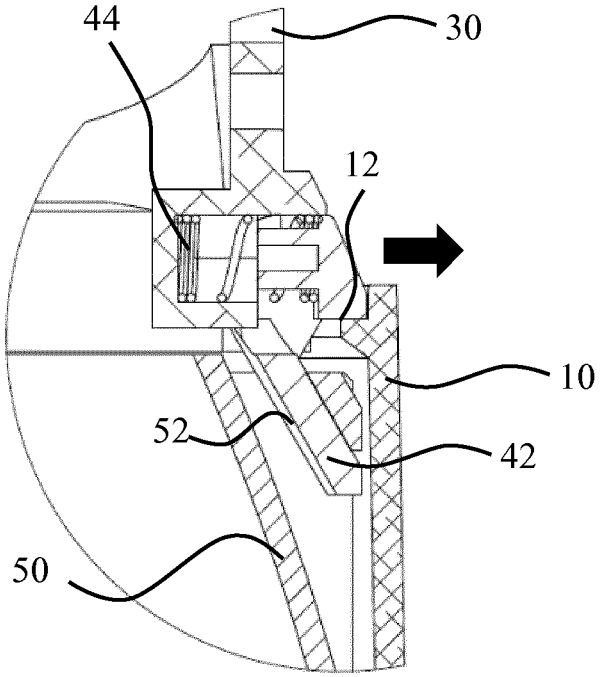
FIG. 5 schematically depicts the interaction between a detail of the luminaire and its annular housing during a second stage of the mounting method.

FIG. 3-5 schematically depict a mounting method according to an example embodiment of the luminaire 20 in the annular housing 10. Upon inserting the luminaire 20 into the annular housing 10, the wedge shape of the one or more clips 40 interacts with the lower rim delimited by the lip 14 such that the push force exerted by the end user to force the luminaire 20 into the annular housing 10 as indicated by the vertical block arrow in FIG. 3 causes the one or more wedge-shaped clips 40 to pushed towards the body 30 of the luminaire 20, thereby compressing or energizing the spring 44 in between the wedge-shaped clip 40 and the body 30. This is shown in more detail in FIG. 4, in which the inwardly directed block arrow indicates the compression of the spring 44 of the wedge-shaped clip 40 against the body 30 upon the wedge-shaped clip 40 engaging with the lower edge of the cylindrical sidewall 11. As previously explained, this reduces the effective diameter of the body 30 to at most the inner diameter 15 of the cylindrical sidewall 11 of the annular housing 10 such that the pressed-in clips 40 of the body 30 of the luminaire 20 can pass along the cylindrical sidewall 11, thereby allowing the insertion of the luminaire 20 into its annular housing 10.

Figure 6:
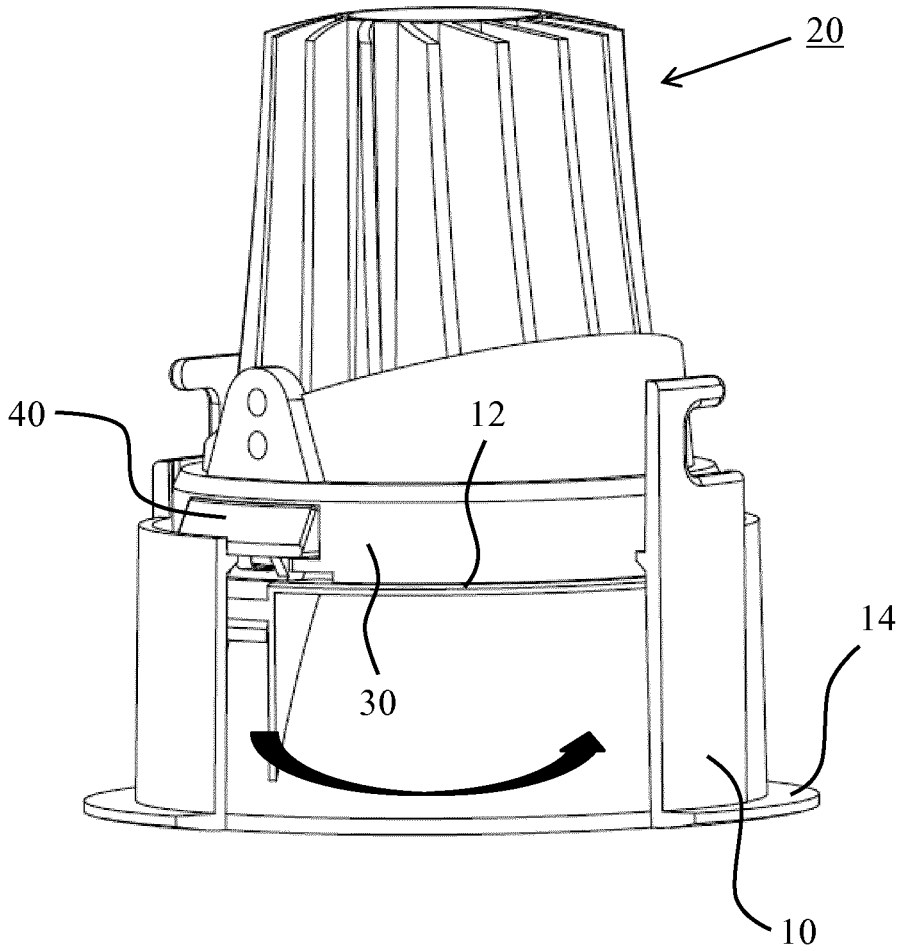
FIG. 6 schematically depicts a luminaire according to an embodiment mounted in its annular housing.

Once the one or more wedge-shaped clips 40 have passed the upper rim 12 of the cylindrical sidewall 11, the energy stored in the compressed spring 44 causes the wedge-shaped clip 40 to be pushed outwardly as indicated by the outwardly pointing block arrow in FIG. 5 such that the effective diameter of the body 30 as defined by the one or more wedge-shaped clips 40 is increased and the wedge-shaped clips 40 extend over the upper rim 12, thereby resting the body 30 of the luminaire 20 onto this upper rim 12. As will be explained in further detail below, a bottom surface of the wedge-shaped clip 40 facing the upper rim 12 preferably is flat and smooth to facilitate easy rotation of the body 30 in the plane of the upper rim 12 by sliding the one or more wedge-shaped clips 40 over the upper rim 12 when mounted in the annular body 10, as schematically depicted in FIG. 6 by the curved block arrow.

As will be understood by the skilled person from the foregoing, in order to release the luminaire 20 from its annular housing 10, the effective diameter of the body 30 will need to be reduced by compressing the one or more wedge-shaped clips 40 against the body 30 such that the one or more wedge-shaped clips 40 are released from the upper rim 12 and the luminaire 20 can be pulled down from its annular housing 10. In order to facilitate the easy release or dismount of the luminaire 20 from its annular housing 10, each wedge-shaped clip 40 further comprises an inclined member 42 that extends from a surface of the clip 40 facing the reflector 50 in an outwardly direction towards the light exit aperture 51 of the reflector 50. In addition, the reflector 50 comprises a groove 52 that is outwardly inclining in the same direction such that the outwardly inclining member 42 of the clip 40 slot into and engages with the outwardly inclining groove 52 of the reflector 50.

Figure 7:
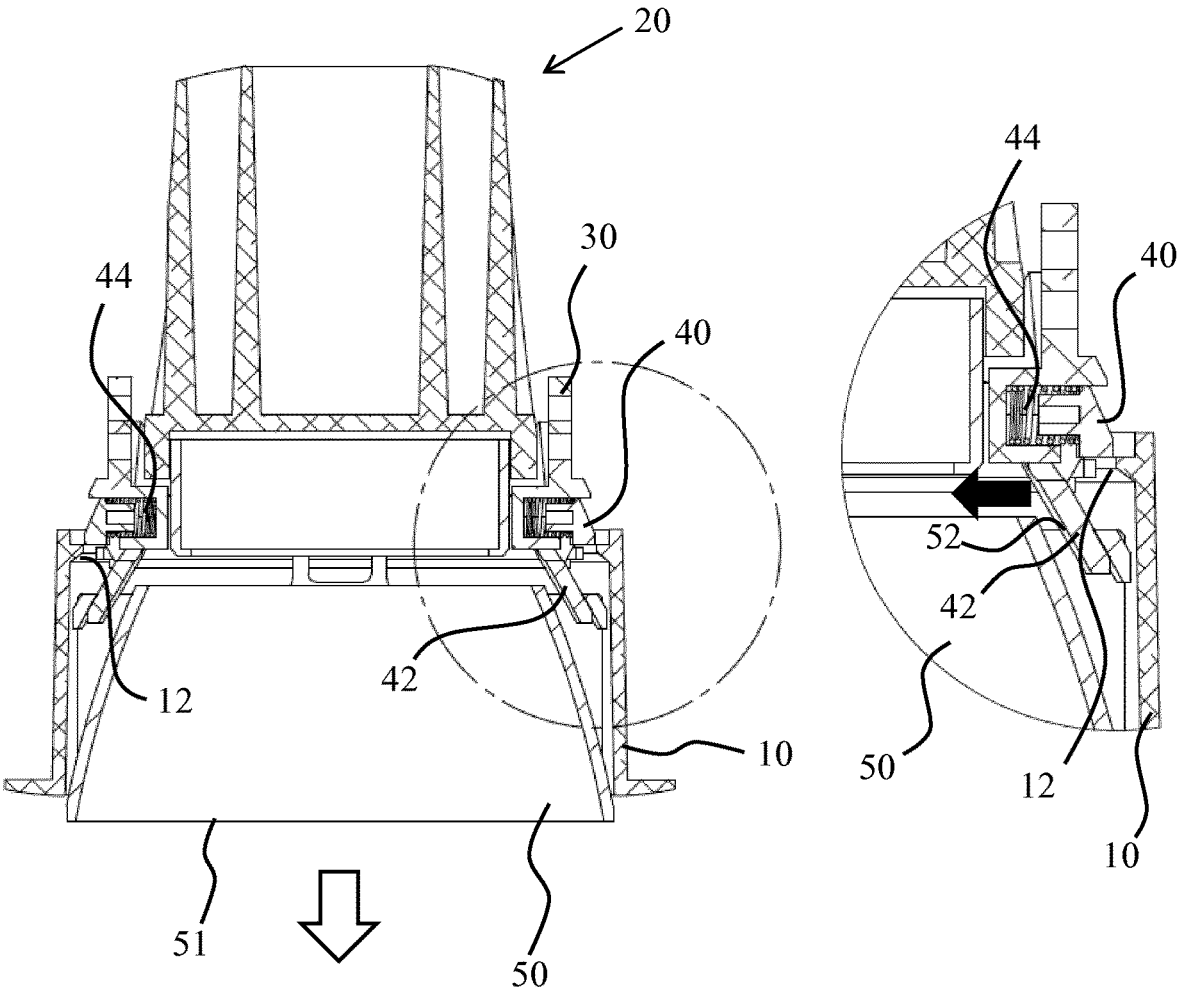
FIG. 7 schematically depicts a dismounting method of a luminaire according to an embodiment from its annular housing, with the inset schematically depicting the interaction between a detail of the luminaire and its annular housing during the dismounting process.

Consequently, when an installer or another end user of the luminaire 20 wishes to dismount the luminaire 20 from the annular housing 10, the user can gently pull down the reflector 50 as schematically depicted in FIG. 7 in which this pulling force is indicated by the downwardly directed block arrow. As this lowers the outwardly inclined groove 52 of the reflector 50, this creates an inwardly directed force onto the outwardly inclining member 42 of the clip 40, thus pushing the clip 40 into the body 30 by compressing the spring 44 as indicated by the inwardly directed block arrow in the inset of FIG. 7, which is a magnified view of the part of the luminaire 20 and annular housing 10 highlighted by the dashed circle in FIG. 7. In this manner, the one or more wedge-shaped clips 40 are pushed inwardly and are released from the upper rim 12 of the annular housing 10, such that the luminaire 20 can be easily dismounted from its annular housing 10 by simply exerting a pulling force onto the reflector 50 without requiring access to the one or more wedge-shaped clips 40.

Figure 8:
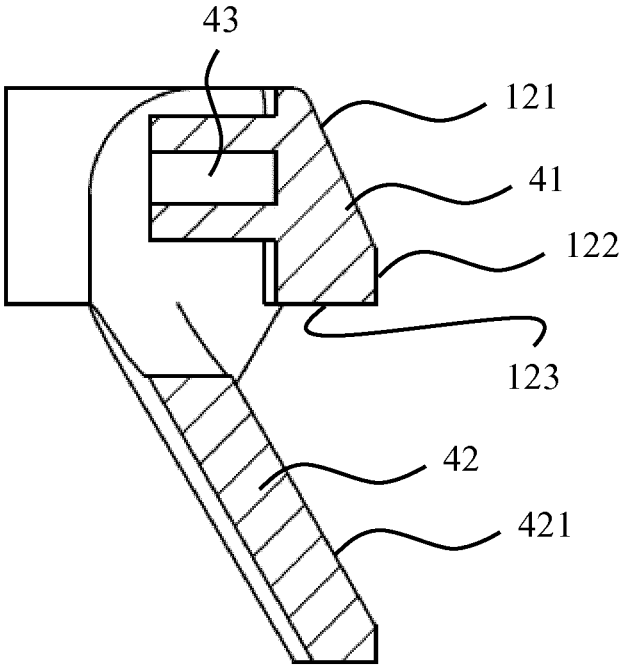
FIG. 8 schematically depicts a cross-sectional view of a wedge-shaped clip according to an example embodiment.
Figure 9:
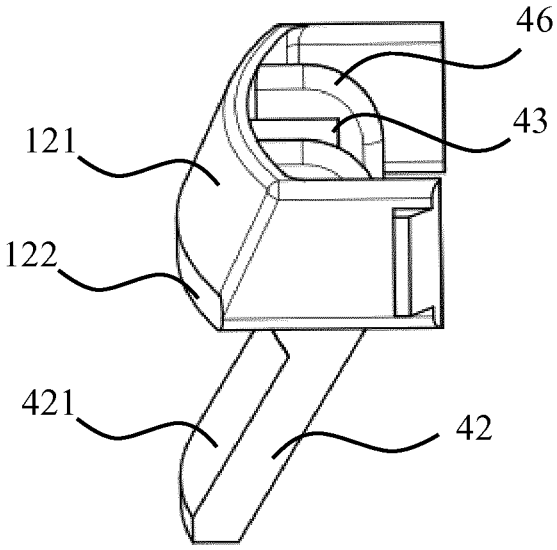
FIG. 9 schematically depicts a perspective view of a wedge-shaped clip according to an example embodiment.
Figure 10:
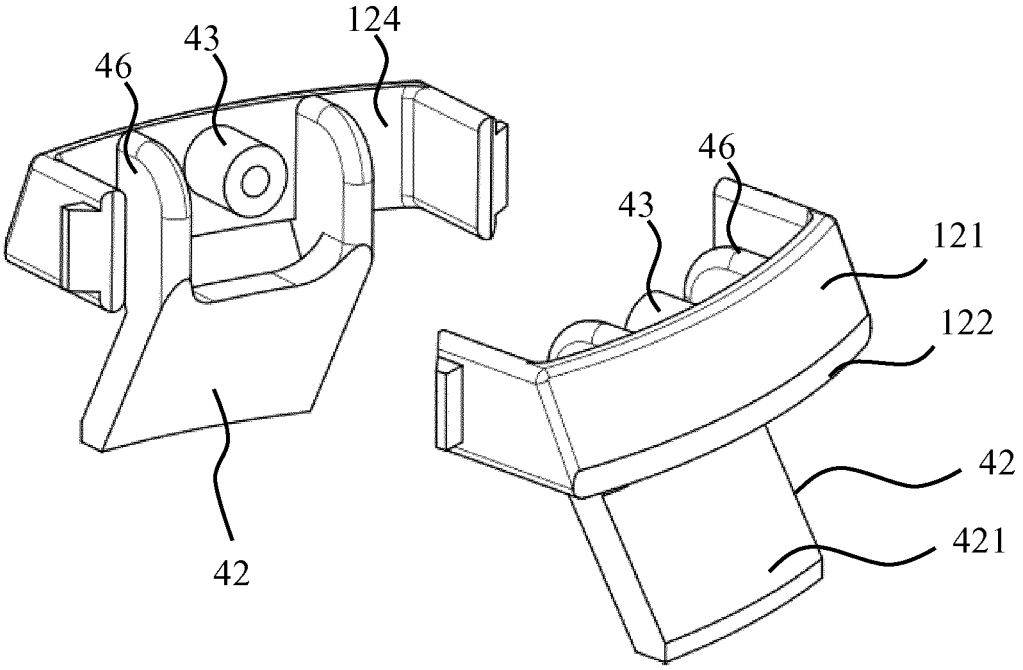
FIG. 10 schematically depicts a perspective view of opposing wedge-shaped clips according to an example embodiment.

The design of the wedge-shaped clip 40 according to an example embodiment is schematically depicted in FIG. 8-10. The wedge-shaped clip 40 comprises a barb-shaped (i.e. wedge-shaped) body 41 having an upper edge and a lower edge thicker than the upper edge, which barb-shaped body 41 is designed to engage with the cylindrical surface 11 and the upper edge 12 of the annular housing 10 into which the luminaire 20 may be mounted. To this end, the barb-shaped body 41 comprises an inclined outer surface 121 extending between its upper edge and lower edge, which typically matches the curvature of the cylindrical sidewall 11 of the annular housing 10 and which allows the clip 40 to be inwardly compressed as previously explained upon engagement of the clip 40 with the cylindrical sidewall 11 of the annular housing 10 when mounting the luminaire 20 in the annular housing 10.

Figure 11:
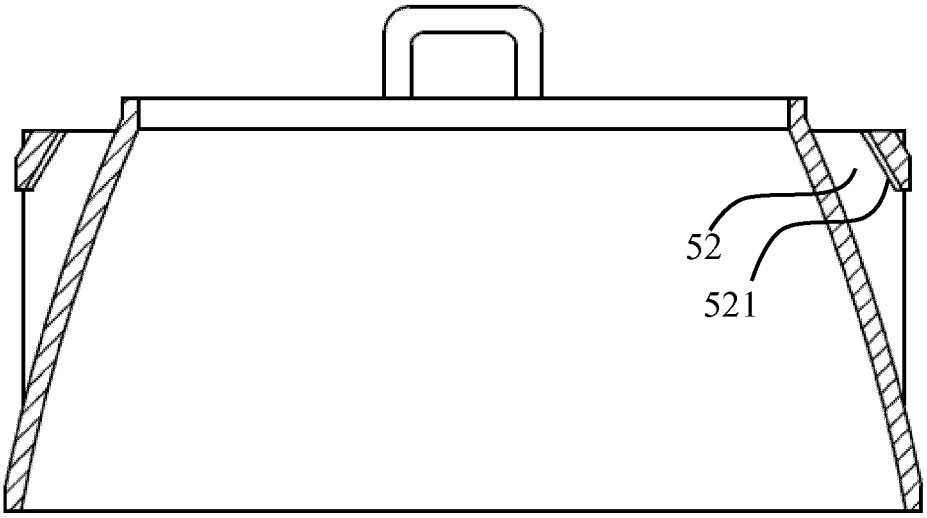
FIG. 11 schematically depicts a cross-sectional view of a reflector of a luminaire according to an example embodiment.

The lower edge typically comprises a first surface 122 extending from the inclined outer surface 121 and a second surface 123 extending from the first surface 122. The first surface 122 typically is arranged to laterally engage with the annular housing 10 once the luminaire 20 is mounted in the annular housing 10. To this end, the upper rim 12 may be delimited by an outer edge (not shown) against which the first surface 122 may be pressed upon release of the clip 40 from the body 30 as explained above. The second surface 123 typically is arranged to rest on the upper rim 12 such that the luminaire 20 can be rotated in the plane of the upper rim 12 as previously explained. The clip 40 may further comprise a mounting post 43 onto which the spring 44 may be mounted, which mounting post 43 may be flanked by a pair of opposing flanges 46 that help to retain the spring 44 onto the mounting post 43. The outwardly inclined member 42 extends from a bottom surface of the barb-shaped body 42 and has an inclined surface 421 that is outwardly arranged when the luminaire 20 is mounted in the annular housing 10 for engaging with a surface 521 of the outwardly inclining groove 52 of the reflector 50, as schematically depicted in FIG. 11. The flanges 46 may additionally or alternatively be used to mount the outwardly inclined member 42 against the barb-shaped body 41 of the clip 40, as most clearly can be seen in FIG. 10, where the flanges 46 extend from the inner surface 124 opposing the inclined outer surface 121 of the barb-shaped body 41.

The luminaire 20 may be provided as a standalone article for retrofitting in an existing (i.e. already installed) annular housing. Alternatively, the luminaire 20 and the annular housing 10 may be provided together as a mounting kit for installing the luminaire 20 in a surface such as a ceiling. It is reiterated that in preferred embodiments the luminaire 20 is a downlight but it should be understood that alternative embodiments of the luminaire 20 may be contemplated without departing from the teachings of the present invention.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The word "comprising" does not exclude the presence of elements or steps other than those listed in a claim. The word "a" or "an" preceding an element does not exclude the presence of a plurality of such elements. The invention can be implemented by means of hardware comprising several distinct elements. In the device claim enumerating several means, several of these means can be embodied by one and the same item of hardware. The mere fact that certain measures are recited in mutually different dependent claims does not indicate that a combination of these measures cannot be used to advantage.

The invention claimed is:

1. A luminaire for mounting in an annular housing having a cylindrical sidewall with an inner diameter, said sidewall terminating in an upper rim, the luminaire comprising a reflector having a light exit aperture mounted in an annular body and a wedge-shaped clip movably attached to the annular body by a spring such that:

the annular body has a first diameter not exceeding the inner diameter when the clip is pressed against the body by compressing said spring;

and a second diameter exceeding the inner diameter when said spring is relaxed;

wherein the clip further comprises an outwardly inclined member in the direction of the light exit aperture and the reflector further comprises an outwardly inclining groove in the direction of the light exit aperture engaging with the outwardly inclined member.

2. The luminaire of claim 1, wherein the luminaire comprises at least a pair of said wedge-shaped clips.

3. The luminaire of claim 1, wherein the annular body comprises a rotatable ring from which each spring extends.

4. The luminaire of claim 3, wherein the rotatable ring comprises an outer ring from which each spring extends, said outer ring resting on the upper rim-when the luminaire is mounted in the annular housing and a pivoting inner ring mounted on the outer ring from which the reflector extends.

5. The luminaire of claim 1, wherein each wedge-shaped clip comprises a barb-shaped body having an upper edge and a lower edge thicker than the upper edge and an inclined outer surface extending between the upper edge and lower edge, said lower edge comprising a first surface and a second surface wherein said first surface is arranged to laterally engage with the housing and the second surface is arranged to rest on the upper rim.

6. The luminaire of any of claim 1, further comprising at least one solid state light element mounted within a chamber delimited by the reflector.

7. The luminaire of claim 1, wherein the luminaire is a downlight.

8. A mounting kit comprising an annular housing having a cylindrical sidewall with an inner diameter, said sidewall terminating in an upper rim and a luminaire according to claim 1.

9. The mounting kit of claim 8, wherein the annular housing is made of a polymer material, a metal or a metal alloy.

10. The mounting kit of claim 8, wherein the luminaire comprises at least a pair of said wedge-shaped clips.

11. The mounting kit of claim 8, wherein the annular body comprises a rotatable ring from which each spring extends.

12. The mounting kit of claim 11, wherein the rotatable ring comprises an outer ring from which each spring extends, said outer ring resting on the upper rim when the luminaire is mounted in the annular body and a pivoting inner ring mounted on the rotatable outer ring from which the reflector extends.

13. The mounting kit of claim 8, wherein the luminaire is a downlight.

14. A method of mounting a luminaire in an annular housing having a cylindrical sidewall with an inner diameter, said sidewall terminating in an upper rim, the luminaire comprising a reflector having a light exit aperture mounted in an annular body and a wedge-shaped clip movably attached to the annular body by a spring such that:

the annular body has a first diameter not exceeding the inner diameter when the clip is pressed against the body by compressing said spring; and a second diameter exceeding the inner diameter when said spring is relaxed;

wherein the clip further comprises an outwardly inclined member in the direction of the light exit aperture and the reflector further comprises an outwardly inclining groove in the direction of the light exit aperture engaging with the outwardly inclined member;

the method comprising:

inserting the luminaire into the annular housing, thereby causing:

the spring to be compressed against the annular body when the clip engages with the cylindrical sidewall; and the clip to be pushed onto the upper rim by the relaxation of said spring upon the clip having passed said cylindrical sidewall.

15. The method of claim 14, further comprising releasing the luminaire from the annular housing by exerting a pulling force on the reflector such that a resulting force exerted by the outwardly inclining groove onto the outwardly inclined member causes said spring to be compressed against the annular body.

* * * * *